United States Patent [19]

Kooy

[11] Patent Number: 4,711,192

[45] Date of Patent: Dec. 8, 1987

[54] RUDDER ASSEMBLY

[76] Inventor: Wayne J. Kooy, Box 292, Galien, Mich. 49113

[21] Appl. No.: 857,247

[22] Filed: Apr. 30, 1986

[51] Int. Cl.[4] ..... B63H 25/06

[52] U.S. Cl. ..... 114/162; 114/165

[58] Field of Search ..... 114/162, 164, 165, 168, 114/39 J

[56] References Cited

U.S. PATENT DOCUMENTS

| | | | |
|---|---|---|---|
| 2,238,844 | 4/1941 | Arbeitlang | 114/165 |
| 3,921,561 | 11/1975 | Arce | 114/165 |
| 3,942,462 | 3/1976 | Ingham | 114/165 |
| 4,008,677 | 2/1977 | Wordell, Sr. | 114/162 |
| 4,046,093 | 9/1977 | Prindle et al. | 114/165 |
| 4,211,180 | 7/1980 | Brooks, Jr. | 114/144 |
| 4,218,986 | 8/1980 | Hackney | 114/165 |
| 4,231,309 | 11/1980 | Pelletier | 114/165 |
| 4,319,538 | 3/1982 | MacFarlane | 114/165 |
| 4,372,241 | 2/1983 | Tritt | 114/162 |
| 4,406,239 | 9/1983 | Enzmann | 114/39 |

FOREIGN PATENT DOCUMENTS

| | | | |
|---|---|---|---|
| 2372078 | 7/1978 | France | 114/162 |

*Primary Examiner*—Joseph F. Peters, Jr.
*Assistant Examiner*—Edwin L. Swinehart
*Attorney, Agent, or Firm*—David Scott Saari

[57] ABSTRACT

A rudder assembly for sailboats which comprises a rudder support frame, a rudder blade, a tiller frame, a pivot bracket, and a lever. With the rudder blade in the lowered position, the weight of the tiller arm bears down on the pivot at the junction of the lever and the pivot bracket preventing the upward movement of the lever and locking the rudder blade in place. To raise the rudder blade, the tiller is lifted up, pulled forward, then pushed down, causing the lever to rotate and pulling the upper rear portion of the rudder blade forward. Adjustments in the rake angle of the rudder blade and the force required to kick up the rudder blade may be made.

3 Claims, 3 Drawing Figures

RUDDER ASSEMBLY

BACKGROUND OF THE INVENTION

1. Field of the Invention

This invention relates to a rudder assembly for use on sailboats and in particular to a kick-up rudder assembly for use on catamarans.

2. Description of the Prior Art

Sailboats and the like often employ retractable rudders which permit the vessel to move into shallow waters or hit obstructions without causing harm to the rudder. Another advantage to a moveable rudder is that weeds which have fouled the rudder may be removed more easily from a retractable rudder.

Typically the rudder blade is moveable between a fully lowered position and a fully raised position. At these positions the rudder blade often is held against further movement by means of a locking mechanism or similar device.

On some catamarans the combination of hull shape and the rudder blades provides resistance to the side thrust of wind on the sail. In the fully lowered position, a portion of the rudder blade often is forward of the pivot that mounts the rudder support frame to the stern of the boat. This arrangement results in a balanced force on the rudder and provides light steering.

Some rudder assemblies allow the rudder blade to be locked into a position intermediate between a fully lowered and a fully raised position. In intermediate positions the force on the rudder blade is not balanced, and steering the boat becomes difficult.

In a number of rudder assemblies now manufactured, a separate level or other means are used to control the position of the rudder blade. On a small boat the helmsman also may handle the lines that control the sails. It may be difficult and possibly dangerous to leave the lines or tiller to use a separate means to raise or to lower the rudder blade. This is even more pronounced on a catamaran where two rudder blades need to be controlled. In the case of a catamaran it is difficult and dangerous to cross over to the leeward side of the boat to raise or to lower the rudder blade; thus it is very desirable to control both rudder blades from the helmsman position.

SUMMARY OF THE INVENTION

The present invention relates to a rudder assembly for sailboats or the like and comprises a rudder support frame pivotally coupled to the stern of a boat, a rudder blade pivotally attached to the rudder support frame, and a tiller frame which is pivotally attached to the rudder blade. The tiller frame is attached to the rudder support frame by means of a pivot bracket and a lever. These parts in combination form a four-bar mechanism. The rudder assembly which I have invented makes use of the vertical motion of the tiller arm to provide leverage to raise and to lower the rudder blade.

In operation the rudder blade normally would be fully lowered and would be disposed in a substantially vertical porition. The weight of the tiller bears down on the pivot at the junction of the lever and the pivot bracket. This force resists the upward movement of the lever essentially locking the rudder blade in the vertical position.

When approaching shallow water or when weeds have fouled to rudder blade, the helmsman lifts up, pulls forward and then pushes down on the tiller arm. This action rotates the lever from the rearward position to the forward position, thus rotating the top of the rudder blade forward and raising the rudder blade to the retracted position. To lower and to lock the rudder blade, the helmsman lifts up, pushes backward and then pushes down on the tiller arm. This action rotates the lever to the rearward position. The lowering and automatic locking of the rudder blade is especially convenient for catamarans because the helmsman can lower and lock the leeward rudder blade via a tiller arm crossbar and thus not have to cross over to the opposite side of the boat.

The rudder blade will also release if it hits bottom in shallow water or an obstruction. In this occurs the rudder blade will move from the fully lowered position to an intermediate position. If deeper water is encountered or the obstruction is passed, the rudder blade may lower automatically and lock in the fully lowered position. The helmsman may assist in this action by pushing rearward and then down on the tiller arm. Alternately the helmsman could raise the rudder blade from an undesirable intermediate position by pulling forward and then down on the tiller arm.

DESCRIPTION OF THE PREFERRED EMBODIMENT

Figure 1:
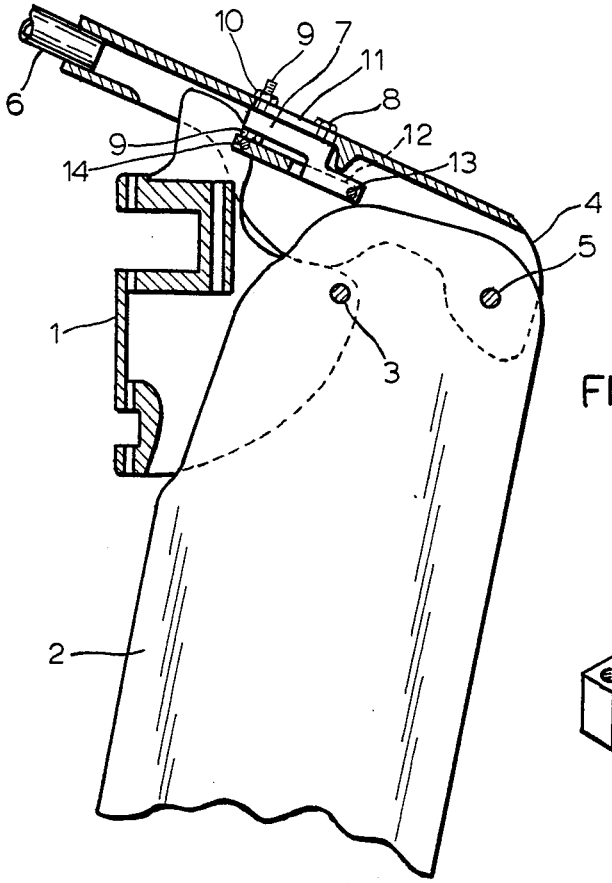
FIG. 1 is a part sectional side elevational view of the rudder assembly showing the rudder blade in the fully lowered position.
Figure 2:
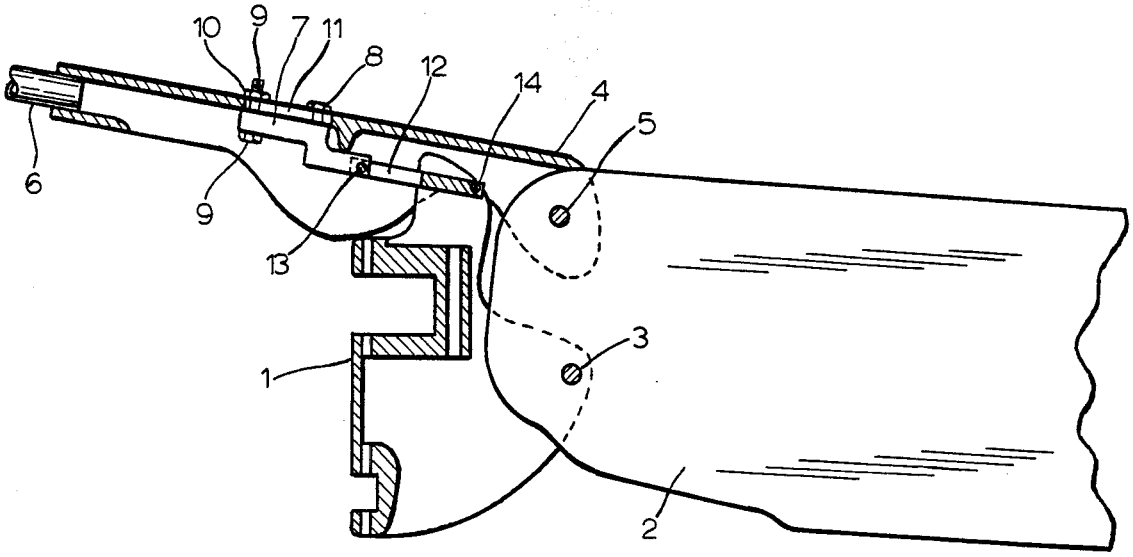
FIG. 2 is a part sectional side elevational view of the rudder assembly showing the rudder blade in the fully raised position.

Referring now to the drawings, the rudder support frame 1, which may be made of cast metal and is similar to other such frames now known, may be attached to the rear of a boat by the conventional means of a pin through holes in the frame. The rudder blade 2 is pivotally attached to the rudder support frame 1 with a pivot bolt 3 or like means. The tiller frame 4 is pivotally attached to the rudder blade 2 with a pivot bolt 5 or like means. The tiller frame 4 is similar to other such frames now known and may be made of cast metal or the like. The position of pivots 3 and 5 are generally as shown in FIGS. 1 and 2, the exact position being dependent on the size and position of other parts yet to be described. The tiller arm 6 is attached to the tiller frame 4 by conventional means not shown in the drawings.

Figure 3:
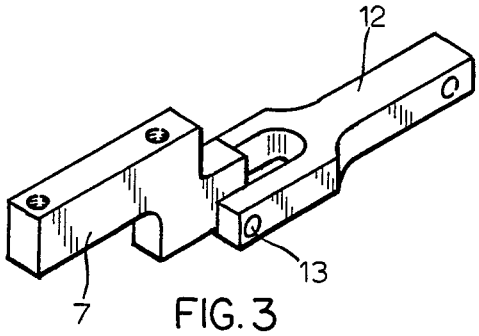
FIG. 3 is an oblique view of the lever and pivot bracket shown in their relative position as in FIG. 2.

The pivot bracket 7 is fastened to the tiller frame 4 with mounting bolt 8, release force adjusting bolt 9 and release force adjusting bolt lock nut 10. The pivot bracket mounting bolts 8 and 9 are fastened to the tiller frame 4 through a slot 11 in the top of the tiller frame which allows the pivot bracket 7 to be adjusted fore and aft which adjusts the rake angle of the rudder blade 2. The shape of pivot bracket 7 may be as shown in FIG. 3 or other shapes which provide mechanical strength while providing a means of attaching the lever 12 to the tiller frame 4 by way of a pivot join 13. While the fore and aft adjustment of the pivot bracket 7 described above is highly desirable, the mechanical advantage afforded by the pivot bracket 7 described below may be accomplished by alternate means such as the incorportion of the bracket into the casting of the tiller frame itself.

The double end of the tuning fork-shaped lever 12 is pivotally attached to the pivot bracket 7 with a pivot join 13. The single end of the lever 12 is attached to the rudder support frame 1 with a pivot pin 14. The length of the lever 12 and the point of attachement of join 14 to the rudder support frame generally are as shown in the FIGS. and more specifically are of a size and position to accomplish the mechanical advantage described below. The tuning fork-shape of lever 12 provides mechanical strength and stability and is the preferred shape for this part of the assembly; although levers of alternate general shapes could provide the mechanical advantage described below.

In operation the rudder blade 2 normally is held in a generally vertical position by the lever 12 as shown in FIG. 1. The obtuse angle formed by pivot joins 5, 13 and 14 determines the mechanical advantage that the weight of the tiller arm 6 provides. This weight acts as a downward force at pivot 13. The angle formed by pivot joins 5, 13 and 14 may be adjusted by changing the position of the head of release force adjusting bolt 9. The head of bolt 9 contacts the lever 12 near pivot 14 and serves as a stop for said lever. As the head of release force adjusting bolt 9 is moved downward, the angle of pivot joins 5, 13 and 14 is increased because pivot join 13 moves up. This decreases the force required to relese the rudder blade 2 from the lower position in the event that said rudder blade contacts an obstruction or the like. Likewise the force required to release the rudder blade 2 may be increased by moving the head of release force adjusting bolt 9 upward. Thus the force required to maintain the rudder blade 2 in the normal position and the force required to release said blade from that position may be set by the judicious placement of joins 5, 13 and 14 and by the raising or lowering of the head of release force adjusting bolt 9.

To raise the rudder blade 2 to the upper position as shown in FIG. 2, the tiller arm 6 is raised, moved forward, and then pulled down. This action causes the lever 12 to rotate about pivot join 14 to the forward position shown in FIG. 2 because of the movement of pivot join 13, pivot bracket 7 and tiller frame 4. This movement causes pivot join 5 to move forward, pulling the top of the rudder blade 2 forward, thus raising said blade to the upper position. The rudder blade 2 is held in the raised position by the weight of the of the tiller arm 6 acting on the lever 12 at pivot 13. When the rudder blade 2 tries to rotate to its lower position due to the weight of the extended portion of the blade, this rotation is prevented by the fact that pivot joins 5, 13 and 14 essentially are in line and that for pivot 5 to move rearward requires pivot 13 to move upward which is prevented by the weight of the tiller arm 6 acting on the lever 12 at join 13. Thus additional mechanical advantage may be had by selecting the length of lever 12 and the position of joins 5, 13 and 14 so as to bring about the arrangement of the joins as described above.

I claim:

1. An improved rudder assembly of the type comprising a rudder support frame (1), a rudder blade (2) pivotally attached to said rudder support frame (1) with a first pivot join (3) and a tiller frame (4) pivotally attached to said rudder blade (2) with a second pivot join (5), wherein the improvement comprises a pivot bracket (7) attached to said tiller frame (4), and a lever (12) pivotally attached near a first end with a third pivot join (14) to said rudder support frame (1) and pivotally attached near a second end with a fourth pivot join (13) to said pivot bracket (7) and rotatable about said third pivot join (14) from a first, substantially horizontal forward position having said fourth (13), third (14) and second (5) pivot joins in approximately a straight line to a second, substantially horizontal rearward position having said second (5), fourth (13) and third (14) pivot joins defining an obtuse angle approximating a straight line.

2. A rudder assembly as recited in claim 1, additionally comprising an adjustable stop means (9) attached to said tiller frame (4) for defining the rearward limit of rotation of said lever (12).

3. A rudder assembly as recited in claim 1 wherein said pivot bracket (7) is adjustably attached to said tiller frame (4) and wherein said attachment is adjustable between a first forward position and a second rearward position.

* * * * *